US007851714B2

(12) United States Patent
Kakuno

(10) Patent No.: US 7,851,714 B2
(45) Date of Patent: Dec. 14, 2010

(54) SWITCH

(75) Inventor: Hideyo Kakuno, Tajimi (JP)

(73) Assignee: OMRON Corporation, Kyoto (JP)

( * ) Notice: Subject to any disclaimer, the term of this patent is extended or adjusted under 35 U.S.C. 154(b) by 253 days.

(21) Appl. No.: 11/821,078

(22) Filed: Jun. 21, 2007

(65) Prior Publication Data

US 2008/0017490 A1 Jan. 24, 2008

(30) Foreign Application Priority Data

Jun. 21, 2006 (JP) ..... 2006-170984

(51) Int. Cl.
*H01H 9/26* (2006.01)

(52) U.S. Cl. ..... 200/5 R; 200/16 A; 200/550

(58) Field of Classification Search ..... 200/4, 200/5 A, 5 R, 16 R, 17 R, 18, 332, 335, 339, 200/537, 541, 547–551, 553, 562, 563, 552, 200/561

See application file for complete search history.

(56) References Cited

U.S. PATENT DOCUMENTS

| | | | | | |
|---|---|---|---|---|---|
| 4,654,487 | A | * | 3/1987 | Sawada | 200/1 V |
| 4,775,767 | A | * | 10/1988 | Sawada et al. | 200/310 |
| 4,899,063 | A | * | 2/1990 | Suck | 307/9.1 |
| 5,063,479 | A | * | 11/1991 | Satoh | 362/555 |
| 5,434,757 | A | * | 7/1995 | Kashiwagi | 362/501 |
| 5,597,989 | A | * | 1/1997 | Nishio | 200/6 R |
| 5,598,918 | A | * | 2/1997 | Malecke et al. | 200/558 |
| 5,623,134 | A | * | 4/1997 | Hayakawa | 200/5 R |
| 5,669,487 | A | * | 9/1997 | Sakata | 200/339 |
| 5,783,785 | A | * | 7/1998 | Furukawa | 200/1 B |
| 5,821,483 | A | * | 10/1998 | Yamaguchi et al. | 200/5 R |
| 5,845,767 | A | * | 12/1998 | Suzuki | 200/524 |
| 6,054,655 | A | * | 4/2000 | Rudolph et al. | 200/16 R |

(Continued)

FOREIGN PATENT DOCUMENTS

EP 0 900 905 A2 3/1999

(Continued)

OTHER PUBLICATIONS

Extended European Search Report issued in European Application No. 07010822.0-1231 May 20, 2009, 7 pages.

(Continued)

*Primary Examiner*—Renee Luebke
*Assistant Examiner*—Lisa N Klaus
(74) *Attorney, Agent, or Firm*—Osha Liang LLP

(57) ABSTRACT

A switch which can prevent detraction of insulation of fixed contacts and facilitate design, manufacturing and assembling works and can be miniaturized is disclosed. In a power window switch, an earth fixed contact **6*e*** is provided at the center and a manual-up fixed contact, an automatic-up fixed contact, a manual-down fixed contact, and an automatic-down fixed contact are arranged in the right-and-left direction are provided as fixed contact on a board along which movable contacts provided to a movable piece are slid by reciprocating motion of the movable piece in the right-and-left direction. The manual-up/down fixed contacts are nearer to the earth fixed contact than the automatic-up/down fixed contacts. The earth fixed contact is designed so that side portions of the earth fixed contact which are near to the manual-up/down fixed contacts are concaved with respect to side portions near to the automatic-up/down fixed contacts.

12 Claims, 13 Drawing Sheets

U.S. PATENT DOCUMENTS

| | | | | |
|---|---|---|---|---|
| 6,091,038 | A * | 7/2000 | Murphy et al. | 200/563 |
| 6,528,742 | B2 * | 3/2003 | Serizawa et al. | 200/5 R |
| 6,565,362 | B2 * | 5/2003 | Hayashi | 439/34 |
| 6,610,945 | B2 * | 8/2003 | Onodera | 200/315 |
| 6,657,316 | B1 * | 12/2003 | Smith et al. | 307/10.1 |
| 6,669,501 | B2 * | 12/2003 | Serizawa et al. | 439/422 |
| 6,686,550 | B2 * | 2/2004 | Seki et al. | 200/553 |
| 6,690,131 | B1 * | 2/2004 | Shimomura et al. | 318/445 |
| 6,750,406 | B2 * | 6/2004 | Komatsu et al. | 200/1 B |
| 6,820,921 | B2 * | 11/2004 | Uleski | 296/152 |
| 6,833,517 | B2 * | 12/2004 | Sotome et al. | 200/5 R |
| 6,866,497 | B2 * | 3/2005 | Saiki | 425/185 |
| 6,884,954 | B2 * | 4/2005 | Onodera | 200/339 |
| 7,102,092 | B2 * | 9/2006 | Hishikawa | 200/339 |
| 2004/0045801 | A1 | 3/2004 | Shimizu et al. | |

FOREIGN PATENT DOCUMENTS

| | | |
|---|---|---|
| JP | 09-245564 A | 9/1997 |
| JP | 2740384 | 1/1998 |
| JP | 3183813 | 4/2001 |

OTHER PUBLICATIONS

Korean Office Action issued in Korean Application No. 10-2007-0060463 mailed May 21, 2009, 3 pages.

* cited by examiner (a)

(b)

SWITCH

BACKGROUND OF THE INVENTION

1. Field of the Invention

The present invention relates to a switch whose electrical connection state is switched by a linear reciprocating motion of a movable piece.

2. Description of Related Art

A switch used as a power window switch to be mounted in a vehicle or the like is provided with a movable contact and a fixed contact. The movable point is slid on the fixed contact in connection with a linear reciprocating motion of a movable piece and comes into contact with or separates from the fixed contact, so that it is kept to a close state or an open state (electrically conductive state or electrically non-conductive state).

FIG. 15 is a perspective view showing an example of a related art power window switch. A power window switch 51 serves to operate a power window at the side of the driver's seat of a vehicle, and it is provided to a switch module (not shown). A knob 52 is supported in U, D directions by inserting shafts (not shown) through holes 52*a* formed at both side surfaces of the knob 52. An operator 53 is provided inside the knob 52 so as to project downwardly. A slider 54 is fitted to the tip of the operator 53. A movable piece 55 is provided to the slider 54 by insert molding. The movable piece 55 is formed of metal having electrical conductivity, designed in an H-shape when viewed from the upper side, and has elasticity. The respective terminal portions of the movable piece 55 project from the right and left side surfaces of the slider 54 to the obliquely downward side. The tips of the respective terminals are provided with movable contacts 55*a* to 55*d*. The upper surface of the movable piece 55 is pressed by a wall (not shown) so that the respective movable contacts 55*a* to 55*d* of the movable piece 55 are brought into contact with the surface of the board 56 under predetermined pressure, and it moves in only the right-and-left direction in parallel to the board 56.

Fixed contacts 56*a* to 56*e* are provided onto the board 56 as shown in FIGS. 15 and 16. The fixed contacts 56*a* to 56*e* are formed of metal having electrical conductivity. An earth fixed contact 56*e* is grounded, and it is provided at the center so as to be wide. A manual-up fixed contact 56*a*, an automatic-up fixed contact 56*b*, a manual-down fixed contact 56*c* and an automatic-down fixed contact 56*d* are provided at the right and left sides of the earth fixed contact 56*e* in parallel to the moving direction of the slider 54 so as to be narrow in width. The manual fixed contacts 56*a*, 56*c* are provided so as to be nearer to the earth fixed contact 56*e* than the automatic fixed contacts 56*b*, 56*d*. In place of this construction, the five fixed contacts described above may be provided to the case of the switch cell in series in the right-and-left direction so as to be spaced from one another at predetermined intervals as disclosed in Japanese Patent No. 3,183,813 (Patent Document 1) described later. Furthermore, as disclosed in Japanese Patent No. 2,740,384 (Patent Document 2), three fixed contacts may be provided to wafer as the inner bottom surface of the case in series in the right-and-left direction so as to be spaced from one another at predetermined intervals.

When the knob 52 is located at a non-rotated neutral position as shown in FIG. 15, the movable contacts 55*a* to 55*d* of the movable piece 55 are separated from the respective fixed contacts 56*a* to 56*e* on the board 56, and the earth fixed contact 56*e* and each of the other fixed contact points 56*a* to 56*d* are kept under a non-conductive state. Under this state, a control circuit for a power window (not shown) does not rotate a motor as a driving source, and thus the power window does not move upwardly and downwardly. When the knob 52 is slightly rotated in the U direction, the movable piece 55 is moved to the left side through the operator 53 and the slider 54, the movable contacts 55*c*, 55*d* come into contact with the earth fixed contact 56*e*, and the movable contact 55*a* comes into contact with the manual-up fixed contact point 56*a*. Accordingly, the manual-up fixed contact 56*a* and the earth fixed contact 56*e* are conducted to each other through the movable piece 55, and the control circuit reversely rotates the motor during only the conduction period, whereby the power window is upwardly moved. Furthermore, when the knob 52 is greatly rotated in the U direction, the movable piece 55 further moves to the left, and the movable contact 55*b* also comes into contact with the automatic-up fixed contact 56*b*. Accordingly, the automatic-up fixed contact 56*b*, the manual-up fixed contact 56*a* and the earth fixed contact 56*e* are conducted to each other, and the control circuit reversely rotates the motor to move the power window upwardly until the power window is perfectly closed.

Conversely, when the knob 52 is rotated in the D direction, the movable piece 55 moves to the right side, the movable contacts 55*a*, 55*b* come into contact with the earth fixed contact 56*e*, and the movable contact 55*c* comes into contact with the manual-down fixed contact 56*c*. Thereafter, the contact state is continued, and the movable contact 55*d* comes into contact with the automatic-down fixed contact 56*d*. Accordingly, the manual-down fixed contact 56*c* and the earth fixed contact 56*e* are conducted to each other, the automatic-down fixed contact 56*d* also comes into contact with the earth fixed contact 56*e*, and the control circuit forwardly rotates the motor to move the power window downwardly during only the conduction period of the contacts 56*c*, 56*e* or until the power window is perfectly opened.

However, in the related art contact structure described above, the earth fixed contact 56*e* at the center and the manual fixed contacts 56*a*, 56*c* at the left and right sides are close to each other and the insulating interval between the contacts 56*a*, 56*c*, 56*e* is narrowed. Therefore, the contacts 55*a* to 55*d*, 56*a*, 56*c*, 56*e* are wore away by arc discharge occurring at the opening/closing time of the fixed contact 56*e* and the fixed contact 56*a*, 56*c*, that is, at the separate/contact time of the movable contacts 55*a* to 55*d* from/to the fixed contacts 56*a*, 56*c*, 56*e*, and generated powder having electrical conductivity adheres to the surface of the insulator between the fixed contacts 56*a*, 56*c*, 56*e*, so that the insulation therebetween may be lost. Furthermore, other foreign matters having electrical conductivity such as water drop or the like may adhere to the surface of the insulator between the fixed contacts 56*a*, 56*c*, 56*e*, so that the insulation therebetween may be lost with high probability. Still furthermore, high precision is required for design, manufacturing and assembling of the contacts 55*a* to 55*d*, 56*a*, 56*c*, 56*e*, etc. and respective parts such as the movable piece, the board, etc., and thus the working is difficult. On the other hand, when the contacts 56*a* to 56*d* are provided at a position which is farther away from the contact 56*e* in the right-and-left direction, the insulating interval between the contacts 56*a*, 56*c*, 56*e* is increased, however, the occupational area of the contacts 56*a* to 56*e* in the board 56 is enlarged by the amount corresponding to the increase of the insulating interval, so that the power window switch 51 is large in size. Such a problem may likewise occur in the contact structures of the patent documents 1, 2.

SUMMARY OF THE INVENTION

The present invention has been implemented to solve the above problem, and has an object to provide a switch that can prevent detraction of the insulating performance of fixed contacts and facilitate the design, manufacturing and assembling work and can be miniaturized.

According to the present invention, there is provided a switch having a fixed contact provided to a board, and a movable contact slidable on the fixed contact and provided to a movable piece reciprocable in the right and left direction, the fixed contact including a first fixed contact provided at the center thereof, second and third fixed contacts provided to one of the right and left sides of the first fixed contact, and fourth and fifth fixed contacts provided to the other side, the second to fifth fixed contacts being aligned with one another in the sliding direction of the movable contact, the second fixed contact being provided to be nearer in the sliding direction to a side portion of the first fixed contact at which the third fixed contact is most adjacent to the first fixed contact as compared with the third fixed contact, and the fourth fixed contact being provided to be nearer in the sliding direction to a side portion of the first fixed contact at which the fifth fixed contact is most adjacent to the first fixed contact as compared with the fifth fixed contact, wherein the first fixed contact is designed so that the side portion thereof near to the second and fourth fixed contacts is concaved with respect to the side portion thereof near to the third and fifth fixed contacts.

In the above construction, even when the second to fifth fixed contacts are not provided at positions which are far away from the right and left sides of the first fixed contact, the insulating interval between the first fixed contact and each of the second and fourth fixed contacts which are nearer to the first fixed contact than the third and fifth fixed contacts can be increased. Therefore, the insulation between the first fixed contact and each of the second and fourth fixed contacts can be prevented from being detracted due to adhesion of electrically conductive powder to the surface of the insulator between the first fixed contact and the second or fourth fixed contact, the powder being generated by abrasion of the first fixed contact and the second and fourth fixed contacts due to arc discharge occurring when the first fixed contact and the second or fourth fixed contact are opened or closed. Furthermore, the insulation due to adhesion of other foreign matters having electrical conductivity to the surface of the insulator between the first fixed contact and the second or fourth fixed contact can be also prevented from being detracted. Furthermore, high precision is not required for the design, manufacturing and assembling works of the movable contact, the fixed contacts and the respective parts such as the movable piece, the boards, etc., and thus the works can be facilitated. Still furthermore, increase of the occupation area of the fixed contacts on the board can be suppressed, so that the switch can be miniaturized.

According to an embodiment of the present invention, the second and fifth fixed contacts are aligned in the sliding direction of the movable contact so as to sandwich the first fixed contact therebetween, and the third and fourth fixed contacts are aligned in the sliding direction of the movable contact so as to sandwich the first fixed contact therebetween.

In the above construction, the second and fourth fixed contacts and the insulator between the first fixed contact and the second or fourth fixed contact are arranged obliquely in the sliding direction of the movable contact, so that the interval concerned can be more increased. Therefore, even when electrically-conductive or electrically-non-conductive foreign matters adhere to the surface of the insulator between the first fixed contact and the second or fourth fixed contact, the foreign matters are prevented from moving from one insulator surface to the other insulator surface in connection with the sliding movement of the movable contact, and thus the insulating performance between the first fixed contact and the second or fourth fixed contact and the contact reliability between the fixed contact and the movable contact can be prevented from being detracted.

Furthermore, in an embodiment of the present invention, the second and third fixed contacts are provided so as to come into contact with the second fixed contact when the movable point comes into contact with the third fixed contact, and the fourth and fifth fixed contacts are provided so as to come into contact with the fourth fixed contact when the movable contact comes into contact with the fifth fixed contact.

In the above construction, by the reciprocating motion of the movable piece, there can be switched to five electrical connection states such as a state that the movable contact separate from the second to fifth fixed contacts and thus the contacts are not conducted to one another, a state that the movable contact is in contact with the first and second fixed contacts and thus the contacts are conducted to each other, a state that the movable contact is in contact with the first, second and third fixed contacts and thus the contacts are conducted to one another, a state that the movable contact is in contact with the first and fourth fixed contacts and thus the fixed contacts concerned are conducted to each other, and a state that the movable contact is in contact with the first, fourth and fifth fixed contacts and the contacts are conducted to one another.

Furthermore, according to an embodiment of the present invention, the second and third fixed contacts are provided so as to be in non-contact with the second fixed contact when the movable point comes into the third fixed contact, and the fourth and fifth fixed contacts are provided so as to be in non-contact with the fourth fixed contact when the movable point comes into contact with the fifth fixed contact.

In the above construction, by the reciprocating motion of the movable piece, there can be provided five switchable electrical connection states of a state that the movable contact separate from the second to fifth fixed contacts and thus the contacts are not conducted to each other, a state that the movable contact is in contact with the first and second fixed contacts and thus the contacts are conducted to each other, a state that the movable contact is in contact with the first and third fixed contacts and thus the contacts are conducted to each other, a state that the movable contact is in contact with the first and fourth fixed contacts and thus the contacts are conducted to each other, and a state that the movable contact is in contact with the first and fifth fixed contacts and thus the contacts are conducted to each other.

Furthermore, in a typical embodiment of the present invention, the switch comprises a power window switch for manipulating an in-vehicle mount type power window, the first fixed contact comprises a grounded earth fixed contact, the second fixed contact comprises a manual-up fixed contact for manually moving the power window upwardly, the third fixed contact comprises an automatic-up fixed contact for automatically moving the power window upwardly, the fourth fixed contact comprises a manual-down fixed contact for manually moving the power window downwardly, and the fifth fixed contact comprises an automatic-down fixed contact for automatically moving the power window downwardly.

As described above, even when the other fixed contacts are not provided so as to be far away from the right and left sides of the earth fixed contact, the insulating interval between the earth fixed contact and the manual-up/down fixed contact nearer to the earth fixed contact than the automatic-up/down fixed contact point can be increased, thereby preventing detraction of the insulation due to adherence of foreign matters having electrical conductivity to the surface of the insulator between the earth fixed contact and the manual-up/down fixed contact. Furthermore, high precision is not required for the design, manufacturing and assembling works of the movable contact and the fixed contacts and respective parts such as the movable piece, the boards, etc., and thus the works can be facilitated. Furthermore, the increase of the occupational area of the fixed contacts on the board can be suppressed, and the power window switch can be miniaturized.

According to the present invention, even when the second to fifth fixed contacts are not provided to the positions which are far away from the right and left sides of the first fixed contact, the insulating interval between the first fixed contact and each of the second and fourth fixed contacts which are nearer to the first fixed contact than the third and fifth fixed contacts can be increased. Therefore, the detraction of the insulation between the first fixed contact and the second or fourth fixed contact can be prevented, the design, manufacturing and assembling works of respective contacts and respective parts can be facilitated, and also the occupational area of the fixed contacts on the board can be suppressed from being increased, so that the switch can be miniaturized.

DESCRIPTION OF PREFERRED EMBODIMENTS

Figure 1:
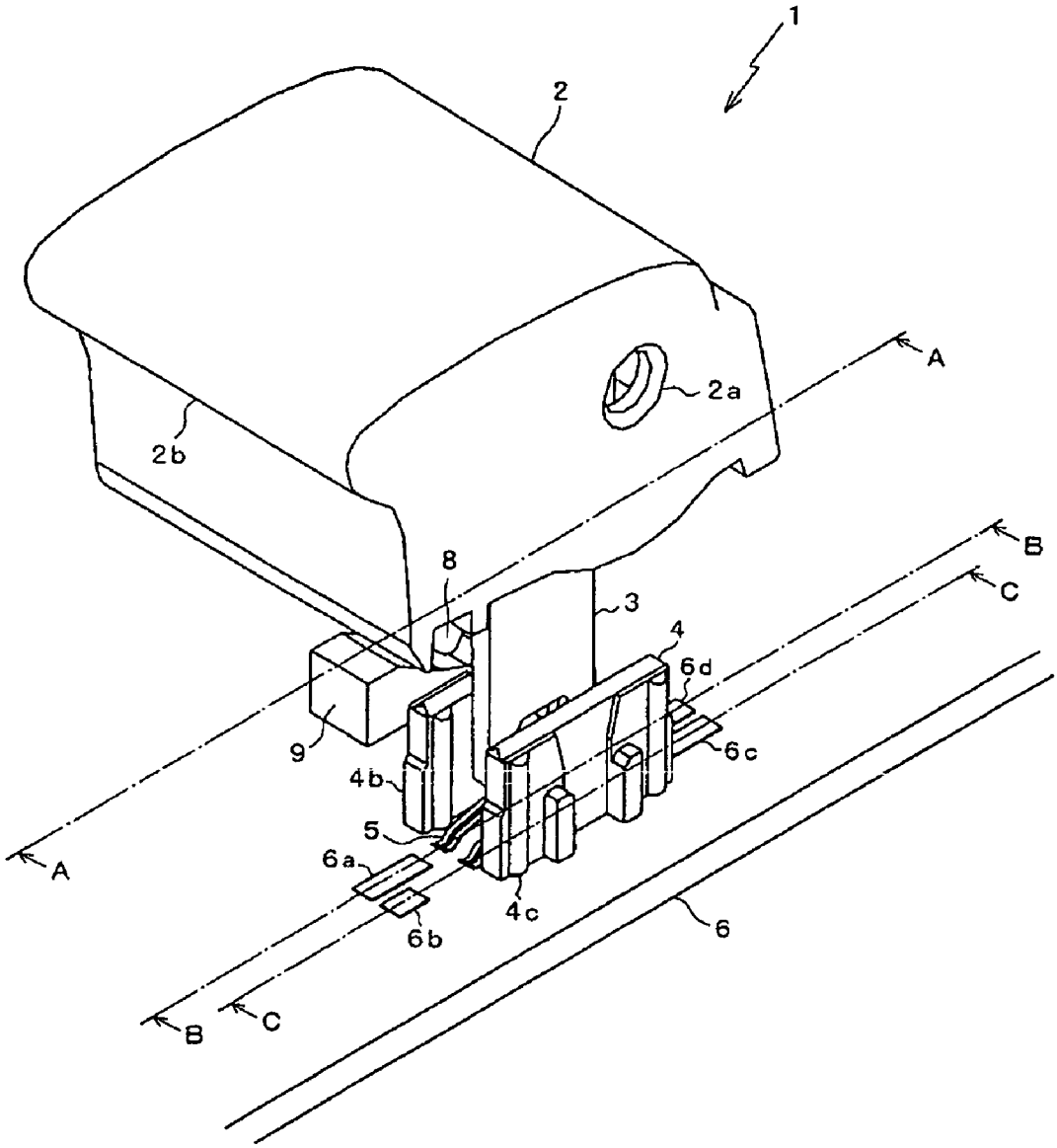
FIG. 1 is a perspective view showing a power window switch according to an embodiment.
Figure 2:
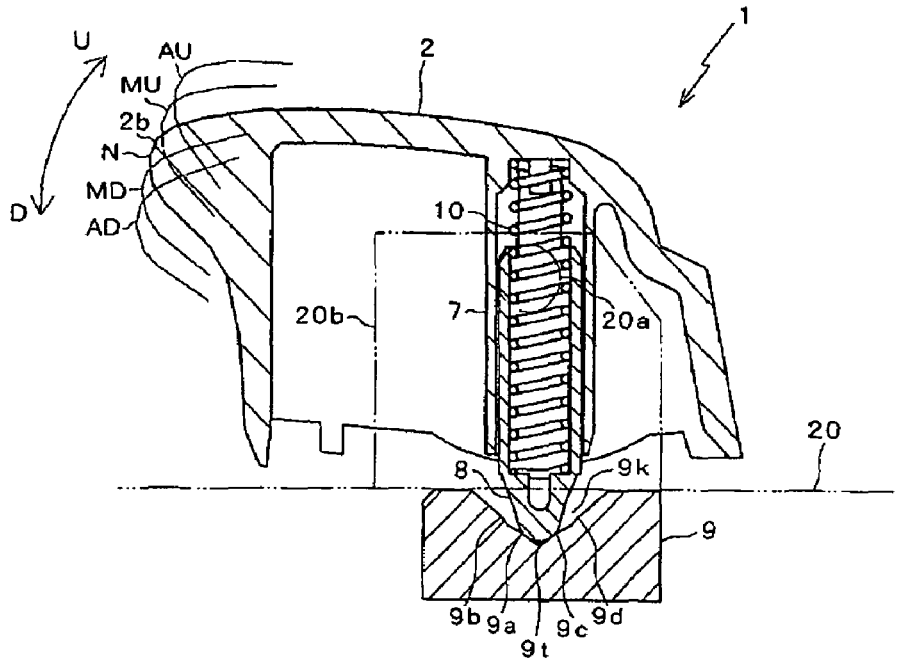
FIG. 2 is an A-A cross-sectional view of FIG. 1.
Figure 3:
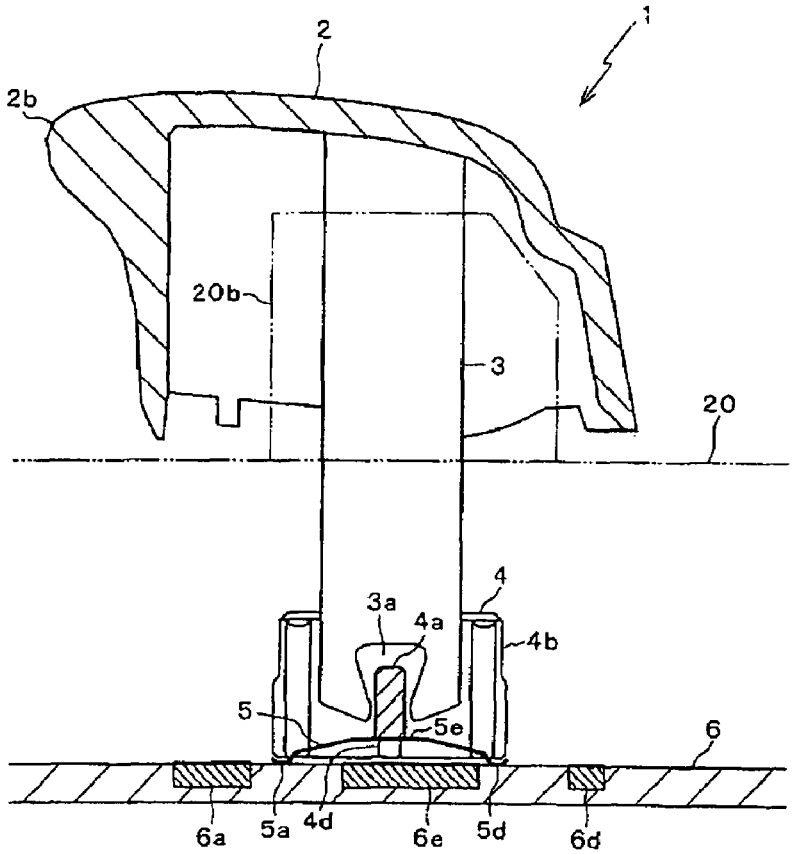
FIG. 3 is a B-B cross-sectional view of FIG. 1.
Figure 4:
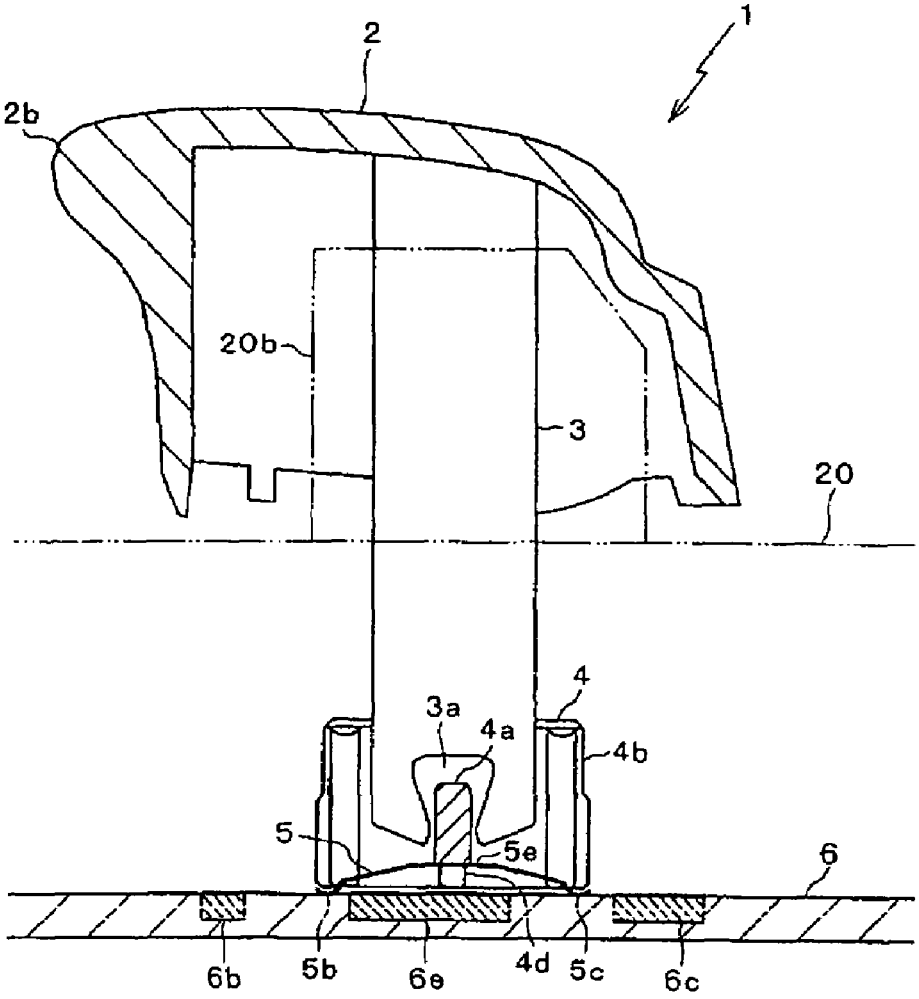
FIG. 4 is a C-C cross-sectional view of FIG. 1.
Figure 14:
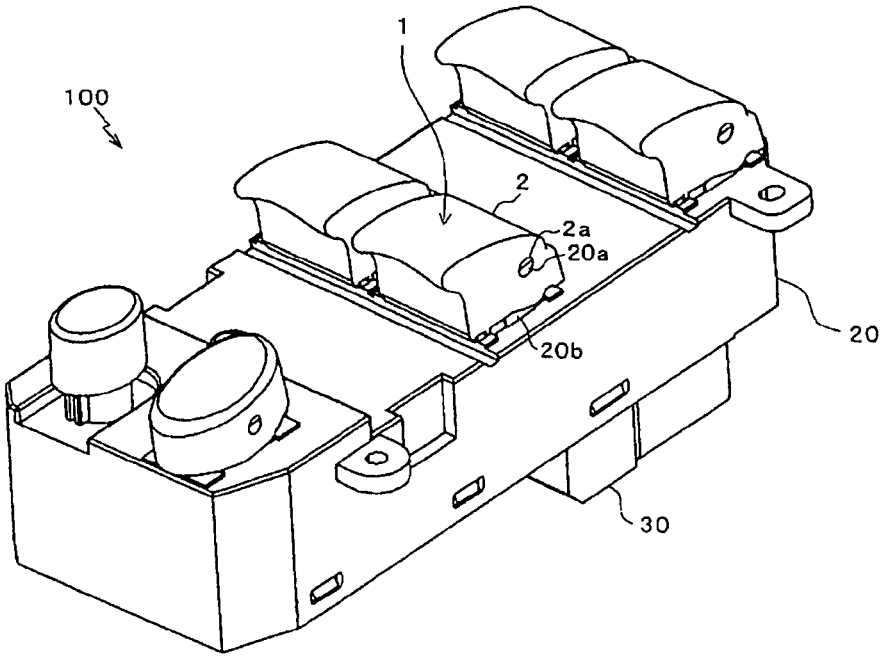
FIG. 14 is a perspective view showing an in-vehicle mount type switch module.
Figure 15:
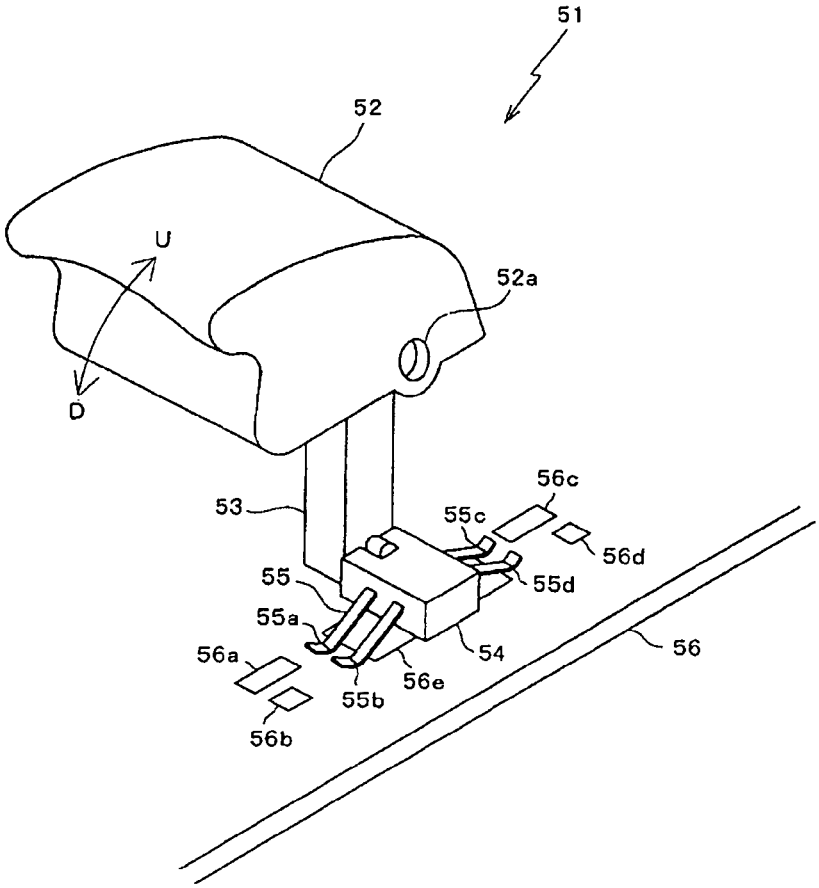
FIG. 15 is a perspective view showing a related art power window switch.
Figure 16:
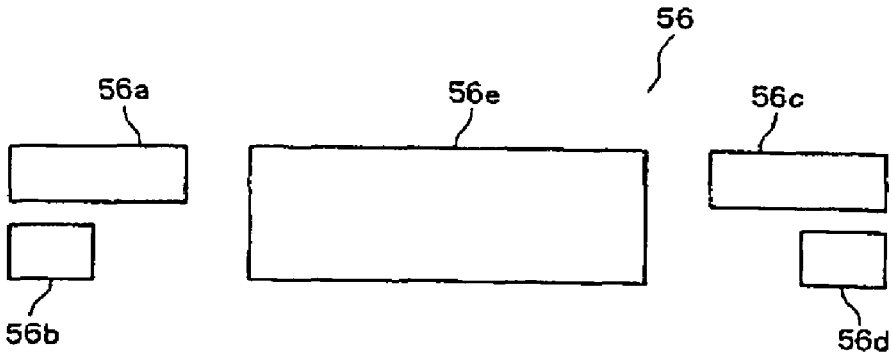
FIG. 16 is a diagram showing fixed contacts on a related art board.

FIG. 1 is a perspective view showing a power window switch 1. FIG. 2 is a A-A cross-sectional view of FIG. 1 of the power window switch 1. FIG. 3 is a B-B cross-sectional view of FIG. 1 of the power window switch 1. FIG. 4 is a C-C cross-sectional view of FIG. 1 of the power window switch 1. The power window switch 1 serves to manipulate the power window at the side of the driver's seat of the vehicle, for example, and it is provided to an in-vehicle mount type switch module 100 as shown in FIG. 14. The switch module 100 is secured to an arm rest of the door of the driver's seat or the like. Parts other than the knob 2 of the power window switch 1 are disposed in lock-engaged upper and lower cases 20, 30 of the switch module 100.

Shafts 20*a* provided on both the side surfaces of a cylinder portion 20*b* of the upper case 20 is engagedly fitted in holes 2*a* provided to both the side surfaces, whereby the knob 2 is secured to the upper portion of the upper case 20 so as to be rotatable around the shafts 20*a* of the upper case 20. A cylinder portion 7 is provided inside the knob 2 so as to be integral with the knob 2 as shown in FIG. 2. The cylinder portion 7 penetrates through the cylinder portion 20*b* of the upper case 20. A detent element 8 and a spring 10 are mounted in the cylinder portion 7. A guide table 9 is provided at the lower side of the cylinder 7 so as to be integral with the upper case 20. The guide table 9 is provided with a substantially V-shaped recess 9*k*. Steps 9*a* to 9*d* are provided to the right and left slope surfaces of the recess 9*k*. The detent element 8 is pressed against the recess 9*k* of the guide table 9 by the spring 10, and swings in the right-and-left direction while following the rotation of the knob 2. At this time, the swing motion of the detent element 8 is guided by the right and left slope surfaces of the recess 9*k*. Furthermore, when the detent element 8 overrides the steps 9*a* to 9*d*, a click sense (detent sense) occurs due to rapid variation of the contact force between the detent element 8 and the guide table 9.

An operator 3 is integrally provided to the knob 2 so as to project downwardly as shown in FIG. 3, etc. The operator 3 penetrates through the cylinder 20*b* of the upper case 20. The operator 3 swings in the right-and-left direction while following the rotation of the knob 2. A recess portion 3*a* is formed at the tip of the operator 3. The recess portion 3*a* is fitted to a cross beam 4*a* provided in the slider 4. The cross beam 4*a* is bridged between both the side walls 4*b*, 4*c* (FIG. 1) of the slider 4, and joints both the side walls 4*b*, 4*c*. A movable piece 5 is secured to the inside of the slider 4. The movable piece 5 is formed of metal having electrical conductivity, and it is designed to be thin in thickness and have elasticity.

Figure 5:
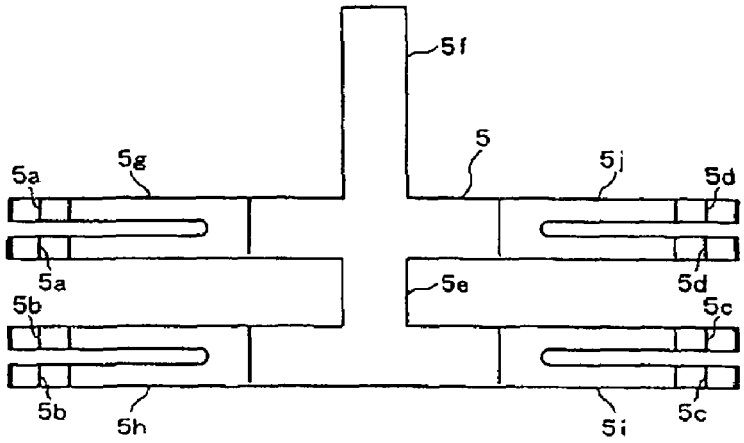
FIGS. 5A and 5B are diagrams showing a movable piece and movable contacts according to an embodiment.
Figure 5:
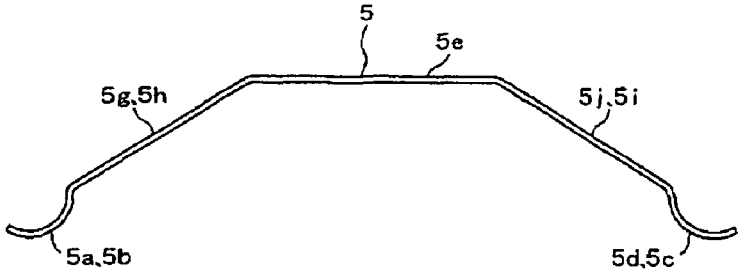

FIGS. 5A and 5B are diagrams showing the movable piece, FIG. 5A is a plan view, and FIG. 5B is a front view. An end portion 5*f* extending from the center portion 5*e* of the movable piece 5 upwardly in FIG. 5A projects in parallel to the center portion 5*e* as shown in FIG. 5B. Every two end portions 5*g*, 5*h*, 5*i*, 5*j* extending from the center portion 5*e* to each of the right and left sides in FIG. 5A are bifurcated at some midpoint and project obliquely downwardly as shown in FIG. 5B. The tips of the end portions 5*g*, 5*h*, 5*i*, 5*j* are bent in an arcuate shape to thereby form movable contacts 5*a* to 5*d*. The end portion 5*f* is press-fitted into a hole (not shown) formed on the side wall 4*b* of the slider 4 and supporting the center portion 5*e* from the upper and lower sides by the cross beam 4*a* of the slider 4 and projections 4*d* formed on both the side portions 4*b*, 4*c* as shown in FIG. 3, etc., whereby the movable piece 5 is held and fixed by the slider 4. The upper surface of the slider 4 is pressed by a wall (not shown) provided integrally with the upper case 20, and movable only in the right-and-left direction in parallel to the board 6. Therefore, the respective end portions 5*g*, 5*h*, 5*i*, 5*j* of the movable piece 5 are elastically deformed, and the respective movable contacts 5*a* to 5*d* are brought into contact with the surface of the board 6 under predetermined pressure. The slider 4 moves in the right-and-left direction in parallel to the board 6 while following the rotation of the knob 2 and the swinging motion of the operator 3.

The board 6 is sandwiched and fixed between the upper and lower cases 20, 30. Electronic parts (not shown) are mounted on the board 6, and an electrical circuit (not shown) is formed on the board 6. The electrical circuit of the board 6 is electrically connected to a control circuit for a power window (not shown) through a cable, a connector or the like (not shown). The control circuit controls the driving of the motor for actuating the power window (not shown) in accordance with the manipulation of the power window switch 1, and upwardly/downwardly the power window to thereby open/close the power window. Fixed contacts 6*a* to 6*e* are provided on the board 6. The fixed contacts 6*a* to 6*e* are formed of metal having electrical conductivity. The movable contacts 5*a* to 5*d* of the movable piece 5 slides on the fixed contacts 6*a* to 6*e* while following the rotation of the knob 2, the swinging motion of the operator 3 and the parallel movement in the right-and-left direction of the slider 4.

Figure 6:
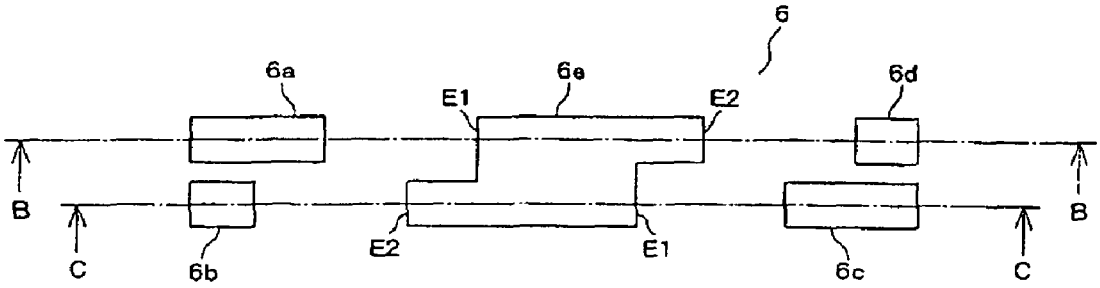
FIG. 6 is a diagram showing fixed contacts on a board according to the embodiment.

FIG. 6 is a diagram showing the fixed contacts 6*a* to 6*e* on the board 6. The earth fixed contact 6*e* is grounded, and provided at the center. The manual-up fixed contact 6*a* and the automatic-up fixed contact 6*b* are provided at the left side of the earth fixed contact 6*e*. The manual-down fixed contact 6*c* and the automatic-down fixed contact 6*d* are provided at the right side of the earth fixed contact 6*e*. The width in the short-side direction of the fixed contacts 6*a* to 6*d* (the width in the direction vertical to the sliding direction (the right-and-left direction) of the movable piece 5) is set to be smaller than the width in the short-side direction of the earth fixed contact 6*e*, and the width in the short-side direction of the earth fixed contact 6*e* is set to be larger than the width in the short-side direction of the fixed contacts 6*a* to 6*d*. The manual-up fixed contact 6*a* serves to manually move the power window upwardly. The automatic-up fixed contact 6*b* serves to automatically move the power window upwardly. The manual-down fixed contact 6*c* serves to manually move the power window downwardly. The automatic-down fixed contact 6*d* serves to automatically move the power window downwardly. The fixed contacts 6*a* to 6*d* are arranged in parallel in the sliding direction (right-and-left direction) of the movable contacts 5*a* to 5*d* of the movable piece 5. The manual-up fixed contact 6*a* is provided so as to be nearer in the sliding direction to a side portion E2 at the left side of the earth fixed contact 6*e* than the automatic-up fixed contact 6*b*, the automatic-up fixed contact 6*b* being most adjacent to the earth fixed contact 6*e* at the side portion E2. The manual-down fixed contact 6*c* is provided so as to be nearer in the sliding direction to a side portion E2 at the right side of the earth fixed contact 6*e* than the automatic-down fixed contact 6*d*, the automatic-down fixed contact 6*d* being most adjacent to the earth fixed contact 6*e* at the side portion E2. The earth fixed contact 6*e* are also designed so that the side portions E1 near to the manual-up fixed contact 6*a* and the manual-down fixed contact 6*c* are concaved so as to be far away from the fixed contact points 6*a*, 6*c* with respect to the side portions E2 near to the automatic-up fixed contact 6*b* and the automatic-down fixed contact 6*d*. The manual-up fixed contact 6*a* and the automatic-down fixed contact 6*d*, and the automatic-up fixed contact 6*b* and the manual-down fixed contact 6*c* are arranged in the sliding direction of the movable contacts 5*a* to 5*d* so as to sandwich the earth fixed contact 6*e* therebetween. The manual-up fixed contact 6*a* and the automatic-up fixed contact 6*b*, and the manual-down fixed contact 6*c* and the automatic-down fixed contact 6*d* are provided so as to come into contact with the manual-up fixed contact 6*a* or the manual-down fixed contact 6*c* when the movable contacts 5*a* to 5*d* come into contact with the automatic-up fixed contact 6*b* or the automatic-down fixed contact 6*d*.

Figure 7:
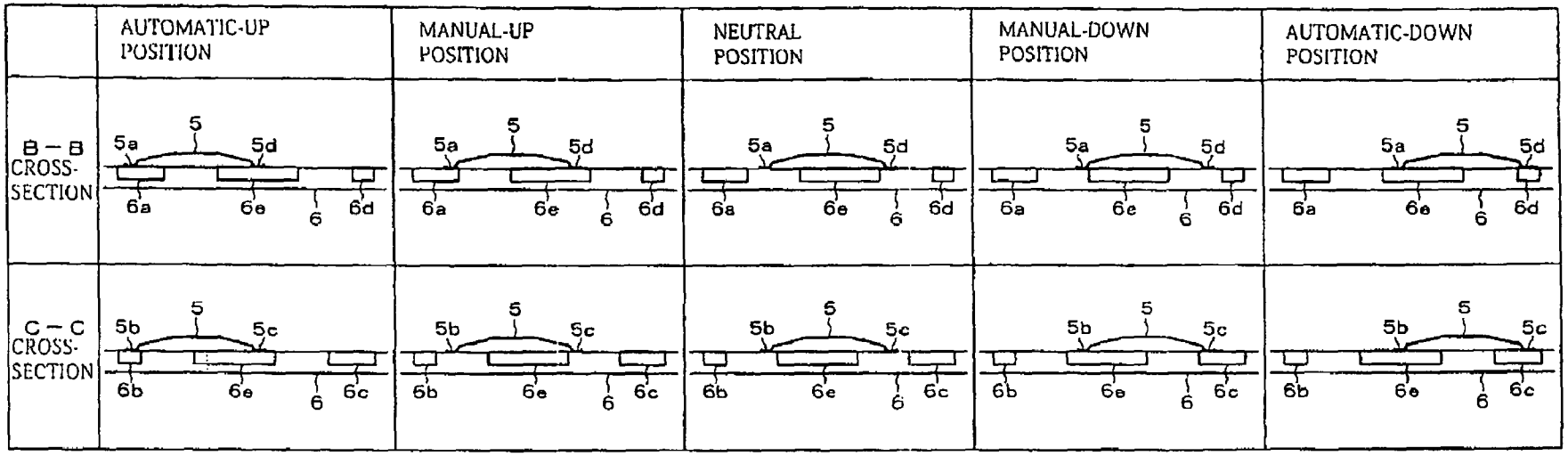
FIG. 7 is a diagram showing the contact states of the movable contacts and the fixed contacts according to the embodiment.

FIG. 7 is a diagram showing the contact states of the movable contacts 5*a* to 5*d* of the movable piece 5 and the fixed contacts 6*a* to 6*e* of the board 6 in a tabular form. In FIG. 7, the upper stage shows the B-B cross-section traversing the movable contacts 5*a*, 5*d* and the fixed contacts 6*a*, 6*d*, 6*e*, and the lower stage shows the C-C cross-section traversing the movable contacts 5*b*, 5*c* and the fixed contacts 6*b*, 6*c*, 6*e*. When the knob 2 is not manipulated by a finger, the cross beam 8 is pressed against the bottom 9*t* of the recess 9*k* by the elastic force of the spring 10 as shown in FIG. 2. Therefore, the knob 2 gets still at the un-rotational neutral position N (indicated by a solid line of FIG. 2) as shown in FIGS. 1 to 4. Furthermore, the operator 3 gets still in a non-swing attitude so as to be vertical to the board 6, and the slider 4 and the movable piece are located at the center of the earth fixed contact 6*e* as shown in FIGS. 3 and 4, etc. Accordingly, as shown on the third column from the left side of FIG. 7, all the movable contacts 5*a* to 5*d* and the fixed contacts 6*a* to 6*e* are separated from one another, and all the fixed contacts 6*a* to 6*e* are kept under a non-conduction state. Under this state, the control circuit for the power window does not rotate the motor, and thus the power window moves neither upwardly nor downwardly.

When the tip portion 2*b* of the knob 2 (FIG. 2, etc.) is pulled up by a finger to slightly rotate the knob 2 from the neutral position N in the U direction, the cross beam 8 is swung to the left along the left slope surface of the recess 9*k*, goes over the step 9*a* at the lower left side and then gets still. Therefore, a click sense is transferred to the knob 2, and the knob 2 gets still at the manual-up position MU indicated by a one-dotted chain line of FIG. 2. Furthermore, the operator 3 is slightly swung to the left and gets still, and the slider 4 and the movable piece 5 slightly moves in parallel to the left and get still. Accordingly, as indicated on the second column from the left side of FIG. 7, the movable contact 5*d* and the earth fixed contact 6*e* come into contact with each other, the movable contact 5*a* and the manual-up fixed contact 6*a* come into contact with each other, and the fixed contacts 6*a*, 6*e* are conducted to each other through the movable piece 5. Under this state, the control circuit reversely rotates the motor during only the period when the fixed contacts 6*a*, 6*e* are conducted to each other, and the power window is moved upwardly.

Furthermore, when the knob 2 is greatly rotated from the neutral position N in the U direction, the cross beam 8 is greatly swung to the left, goes over the step 9*b* at the upper left side of the recess 9*k* and gets still. Therefore, the click sense is transmitted to the knob 2, and the knob 2 gets still at the automatic-up position AU indicated by a two-dotted chain line of FIG. 2. Furthermore, the operator 3 is greatly swung to the left and gets still, and the slider 4 and the movable piece 5 greatly move in parallel to the left and get still. Accordingly, as indicated on the first column from the left side of FIG. 7, the movable contact 5*a* and the movable contact 5*d* are kept in contact with the manual-up fixed contact 6*a* and the earth fixed contact 6*e*, the movable contact 5*b* comes into contact with the automatic-up fixed contact 6*b*, the movable contact 5*c* comes into contact with the earth fixed contact 6*e*, and the fixed contacts 6*a*, 6*b*, 6*e* are conducted to one another through the movable piece 5. Under this state, the control circuit reversely rotates the motor to move the power window upwardly until the power window is completely closed.

Conversely, when the tip portion 2*b* of the knob 2 is pressed down by a finger to slightly rotate the knob 2 from the neutral position N in the D direction, the cross beam 8 is swung to the right along the right slope surface of the recess 9*k*, goes over the step 9*c* at the lower right side and gets still. Therefore, the click sense is transferred to the knob 2, and gets still at a manual-down position MD indicated by a one-dotted chain line of FIG. 2. Furthermore, the operator 3 is swung to the right and then gets still, and the slider 4 and the movable piece 5 moves in parallel to the right and gets still. Accordingly, as indicated on the second column from the right side of FIG. 7, the movable contact 5*c* comes into contact with the manual-down fixed contact 6*c*, the movable contact 5*b* comes into contact with the earth fixed contact 6*e*, and the fixed contacts 6*c*, 6*e* are conducted to each other through the movable piece 5. Under this state, the control circuit forwardly rotates the motor to move the power window downwardly during only the period when the fixed contacts 6*c*, 6*e* are conducted to each other.

Furthermore, when the knob 2 is greatly rotated from the neutral position N in the D direction, the cross beam 8 is greatly swung to the right, goes over the step 9*d* at the upper right side of the recess 9*k* and gets still. Therefore, the click sense is transferred to the knob 2, and gets still at the automatic-down position AD indicated by a two-dotted chain line of FIG. 2. Furthermore, the operator 3 is greatly swung to the right and gets still, and the slider 4 and the movable piece 5 greatly move in parallel to the right and get still. Accordingly, as indicated on the first column from the right side of FIG. 7, the movable contact 5*c* and the movable contact 5*b* are kept in contact with the manual-down fixed contact 6*c* and the earth fixed contact 6*e*, the movable contact 5*d* comes into contact with the automatic-down fixed contact 6*d*, the movable contact 5*a* comes into contact with the earth fixed contact 6*e*, and the fixed contacts 6*c*, 6*d*, 6*e* are conducted to one another through the movable piece 5. Under this state, the control circuit forwardly rotates the motor to move the power window downwardly until the power window is completely opened.

Furthermore, when the finger is separated from the knob 2 after the knob 2 is rotated as described above, the cross beam 8 is pressed against the bottom 9*t* of the recess 9*k* by the elastic force of the spring 10 as shown in FIG. 2. Therefore, as shown in FIGS. 1 to 4, the knob 2 returns to the neutral position N and gets still, the operator 3 returns to the attitude under which it is vertical to the board 6, and the slider 4 and the movable piece 5 return to the center of the earth fixed contact 6*e* and get still. Accordingly, as indicated on the third column from the left side of FIG. 7, all the movable contacts 5*a* to 5*d* and the fixed contacts 6*a* to 6*e* are separated from one another, and all the fixed contacts 6*a* to 6*e* are kept under the non-conduction state.

Figure 8:
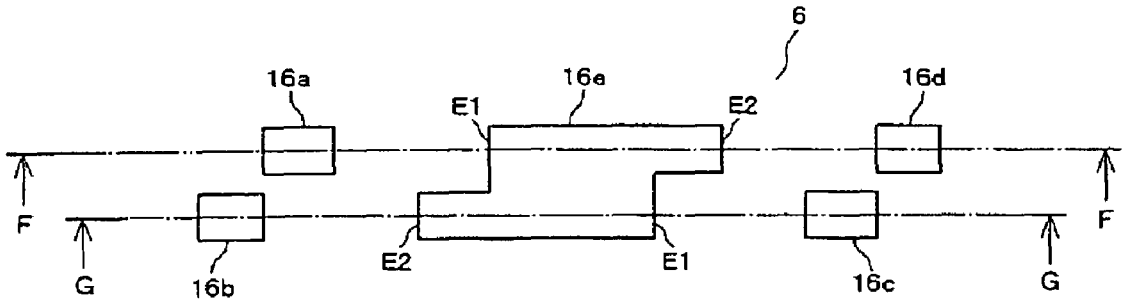
FIG. 8 is a diagram showing the fixed contacts on the board according to another embodiment.

In place of the fixed contacts 6*a* to 6*e* shown in FIG. 6, etc., the fixed contacts 16*a* to 16*e* as shown in FIG. 8 may be provided on the board 6, for example. The manual-up fixed contact 16*a*, the automatic-up fixed contact 16*b*, the manual-down fixed contact 16*c*, the automatic-down fixed contact 16*d* and the earth fixed contact 16*e* of FIG. 8 are identical in function and use application to the respective fixed contacts 6*a* to 6*e* having the same names. Accordingly, the operation of the power window when each of the fixed contacts 16*a* to 16*d* is conducted to the fixed contact 16*e* is identical to that when each of the fixed contacts 6*a* to 6*d* is conducted to the fixed contact 6*e*. The difference of the fixed contacts 16*a* to 16*e* from the fixed contacts 6*a* to 6*e* resides in that the manual-up fixed contact 16*a* and the automatic-up fixed contact 16*b*, and the manual-down fixed contact 16*c* and the automatic-down fixed contact 16*d* are provided so that when the movable contacts 5*a* to 5*d* of the movable piece 5 come into contact with the automatic-up fixed contact 16*b* or the automatic-down fixed contact 16*d*, they are kept to be in non-conduction with the manual-up fixed contact 16*a* or the manual-down fixed contact 16*c*.

Figure 9:
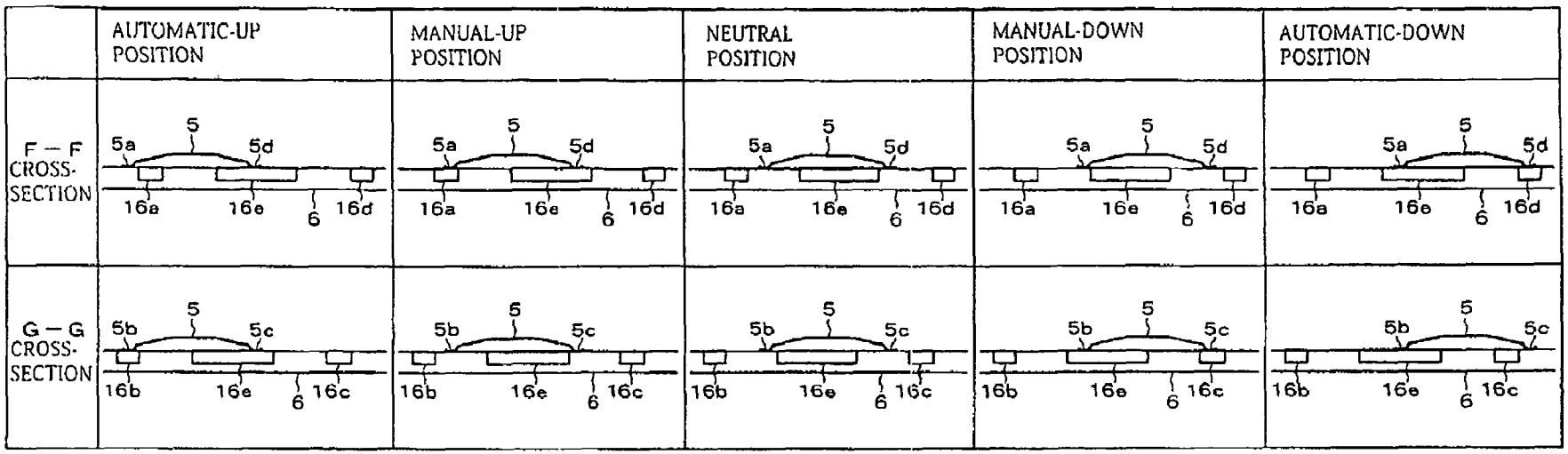
FIG. 9 is a diagram showing the contact states of movable contacts and the fixed contacts according to another embodiment.

FIG. 9 is a diagram showing the contact states of the movable contacts 5*a* to 5*d* and the fixed contacts 16*a* to 16*e* in a tabular form. In FIG. 9, the upper stage shows the F-F cross-section traversing the movable contacts 5*a*, 5*d* and the fixed contacts 16*a*, 16*d*, 16*e*, and the lower stage shows the G-G cross-section traversing the movable contacts 5*b*, 5*c* and the fixed contacts 16*b*, 16*c*, 16*e*. When the knob 2 is located at the neutral position N, as indicated on the third column from the left side of FIG. 9, the movable piece 5 is located at the center of the earth fixed contact 16*e*, all the movable contacts 5*a* to 5*d* and the fixed contacts 16*a* to 16*e* are separated from one another, and the fixed contacts 16*a* to 16*e* are kept under non-conduction state. When the knob 2 is rotated till the manual-up position MU, as indicated on the second column from the left side of FIG. 9, the movable piece 5 moves in parallel to the left, the movable contact 5*d* comes into contact with the earth fixed contact 16*e*, the movable contact 5*a* comes into contact with the manual-up fixed contact 16*a*, and the fixed contacts 16*a*, 16*e* are conducted to each other. When the knob 2 is rotated till the automatic-up position AU, as indicated on the first column from the left side of FIG. 9, the movable piece 5 further moves in parallel to the left, the movable contact 5*a* is separated from the manual-up fixed contact 16*a*, the movable contact 5*b* comes into contact with the automatic-up fixed contact 16*b*, the movable contacts 5*c*, 5*d* come into contact with the fixed contact 16*e*, and the fixed contacts 16*b*, 16*e* are conducted to each other. When the knob 2 is rotated till the manual-down position MD, as indicted on the second column from the right side of FIG. 9, the movable piece 5 moves in parallel to the right, the movable contact 5*b* comes into contact with the earth fixed contact 16*e*, the movable contact 5*c* comes into contact with the manual-down fixed contact 16*c*, and the fixed contacts 16*c*, 16*e* are conducted to each other. When the knob 2 is rotated till the automatic-down position AD, as indicated on the first column from the right side of FIG. 9, the movable piece 5 further moves in parallel to the right, the movable contact 5*c* is separated from the manual-down fixed contact 16*c*, the movable contact 5*d* comes into contact with the automatic-down fixed contact 16*d*, the movable contacts 5*a*, 5*b* come into contact with the earth fixed contact 16*e*, and the fixed contacts 16*d*, 16*e* are conducted to each other.

Figure 10:
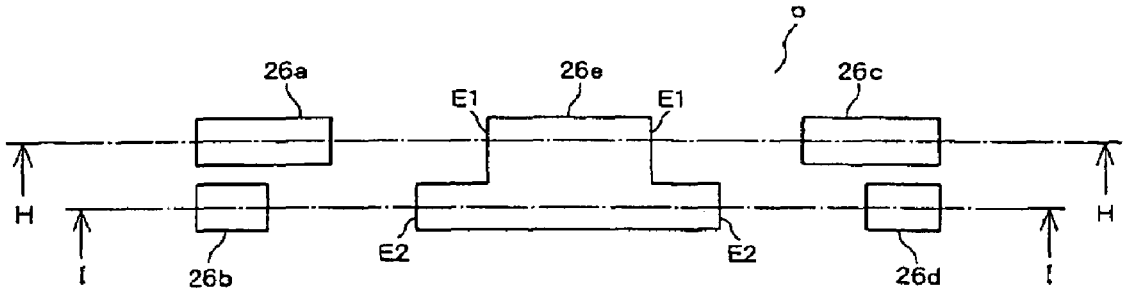
FIG. 10 is a diagram showing the fixed contacts on the board according to another embodiment.

Furthermore, fixed contacts 26*a* to 26*e* as shown in FIG. 10 may be provided on the board 6, for example. The manual-up fixed contact 26*a*, the automatic-up fixed contact 26*b*, the manual-down fixed contact 26*c*, the automatic-down fixed contact 26*d* and the earth fixed contact 26*e* of FIG. 10 are identical in function and use application to the respective fixed contacts 6*a* to 6*e* having the same names. Accordingly, the operation of the power window when each of the fixed contacts 26*a* to 26*d* are conducted to the fixed contact 26*e* is identical to that when each of the fixed contacts 6*a* to 6*e* is conducted to the fixed contact 6*e*. The difference of the fixed contacts 26*a* to 26*e* from the fixed contacts 6*a* to 6*e* resides in that the manual-up fixed contact 26*a* and the manual-down fixed contact 26*c*, and the automatic-up fixed contact 26*b* and the automatic-down fixed contact 26*d* are arranged in the sliding direction (right-and-left direction) of the movable contacts 5*a* to 5*d* so as to sandwich the earth fixed contact 26*e* therebetween. Furthermore, the earth fixed contact 26*e* is designed so that the side portions E1 near to the manual-up fixed contact 26*a* and the manual-down fixed contact 26*c* are concaved with respect to the side portions E2 near to the automatic-up fixed contact 26*b* and the automatic-down fixed contact 26*d* so as to separate from the fixed contacts 26*a*, 26*c*.

Figure 11:
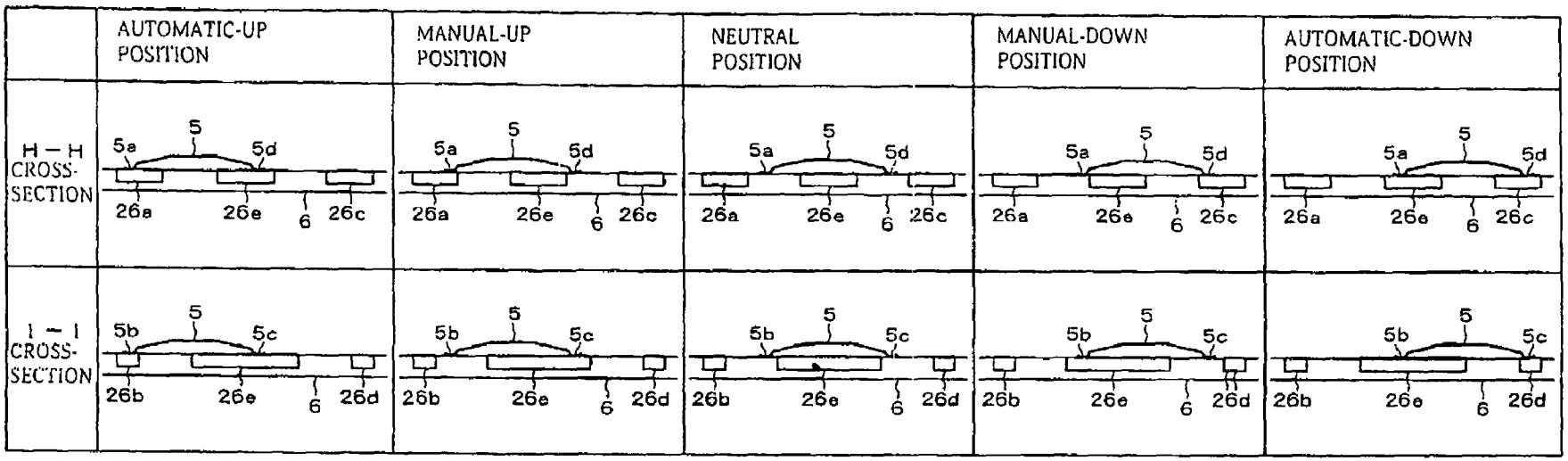
FIG. 11 is a diagram showing the contact states of the movable contacts and the fixed contacts according to another embodiment.

FIG. 11 is a diagram showing the contact states between the movable contacts 5*a* to 5*d* and the fixed contacts 26*a* to 26*e* in a tabular form. In FIG. 11, the upper stage shows the H-H cross-section traversing the movable contacts 5*a*, 5*d* and the fixed contacts 26*a*, 26*c*, 26*e*, and the lower stage shows the I-I cross-section traversing the movable contacts 5*b*, 5*c* and the fixed contacts 26*b*, 26*d*, 26*e*. When the knob 2 is located at the neutral position N, as indicated on the third column from the left side of FIG. 11, the movable piece 5 is located at the center of the earth fixed contact 26*e*, all the movable contacts 5*a* to 5*d* and the fixed contacts 26*a* to 26*e* are separated from one another, the fixed contacts 26*a* to 26*e* are kept under the non-conduction state. When the knob 2 is rotated till the manual-up position MU, as indicated on the second column from the left side of FIG. 11, the movable piece 5 moves in parallel to the left, the movable contact 5*c* comes into contact with the earth fixed contact 26*e*, the movable contact 5*a* comes into contact with the manual-up fixed contact 26*a*, and the fixed contacts 26*a*, 26*e* are conducted to each other. When the knob 2 is rotated till the automatic-up position AU, as indicated on the first column from the left side of FIG. 11, the movable piece further moves in parallel to the left, the movable contact 5*a* and the movable contact 5*c* are kept in contact with the manual-up fixed contact 26*a* and the earth fixed contact 26*e*, the movable contact 5*b* comes into contact with the automatic-up fixed contact 26*b*, the movable contact 5*d* comes into contact with the earth fixed contact 26*e*, and the fixed contacts 26*a*, 26*b*, 26*e* are conducted to one another. When the knob 2 is rotated till the manual-down position MD, as indicated on the second column from the right side of FIG. 11, the movable piece 5 moves in parallel to the right, the movable contact 5*b* comes into contact with the earth fixed contact 26*e*, the movable contact 5*d* comes into contact with the manual-down fixed contact 26*c*, and the fixed contacts 26*c*, 26*e* are conducted to each other. When the knob 2 is rotated till the automatic-down position AD, as indicated on the first column from the right of FIG. 11, the movable piece 5 further moves in parallel to the right, the movable contact 5*d* and the movable contact 5*b* are kept in contact with the manual-down fixed contact 26*c* and the earth fixed contact 26*e*, the movable contact 5*c* comes into contact with the automatic-down fixed contact 26*d*, the movable contact 5*a* comes into contact with the earth fixed contact 26*e*, and the fixed contacts 26*c*, 26*d*, 26*e* are conducted to one another.

Figure 12:
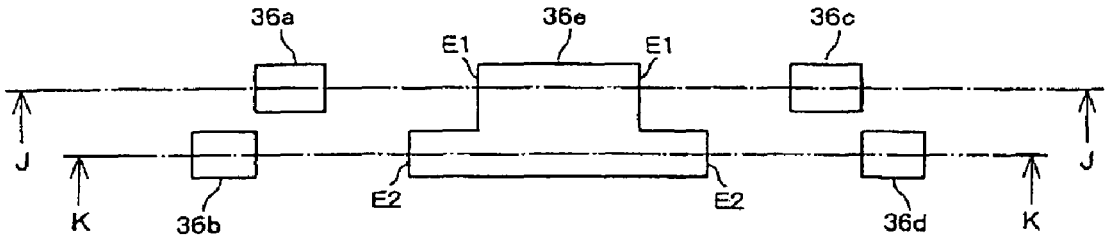
FIG. 12 is a diagram showing the fixed contacts on the board according to another embodiment.

Furthermore, fixed contacts 36*a* to 36*e* as shown in FIG. 12 may be provided on the board 6. The manual-up fixed contact 36*a*, the automatic-up fixed contact 36*b*, the manual-down fixed contact 36*c*, the automatic-down fixed contact 36*d* and the earth fixed contact 36*e* are identical in function and use application to the respective fixed contacts 6*a* to 6*e* having the same names. Accordingly, the operation of the power window when the respective fixed contacts 36*a* to 36*d* are conducted to the fixed contact 36*e* is identical to that when the respective fixed contacts 6*a* to 6*d* are conducted to the fixed contact 6*e*. The difference of the fixed contacts 36*a* to 36*e* from the fixed contacts 6*a* to 6*e* resides in that the manual-up fixed contact 36*a* and the manual-down fixed contact 36*c*, and the automatic-up fixed contact 36*b* and the automatic-down fixed contact 36*d* are arranged in the sliding direction of the movable contacts 5*a* to 5*d* so as to sandwich the earth fixed contact 36*e* therebetween. Furthermore, the earth fixed contact 36*e* is designed to that the portions E1 thereof near to the manual-up fixed contact 36*a* and the manual-down fixed contact 36*c* are concaved with respect to the side portions E2 near to the automatic-up fixed contact 36*b* and the automatic-down fixed contact 36*d* so as to be far away from the fixed contacts 36*a*, 36*c*. Furthermore, the manual-up fixed contact 36*a* and the automatic-up fixed contact 36*b*, and the manual-down fixed contact 36*c* and the automatic-down fixed contact 36*d* are provided so that when the movable contacts 5*a* to 5*d* of the movable piece 5 comes into contact with the automatic-up fixed contact 36*b* or the automatic-down fixed contact 36*d*, they are separated from the manual-up fixed contact 36*a* or the manual-down fixed contact 36*c*.

Figure 13:
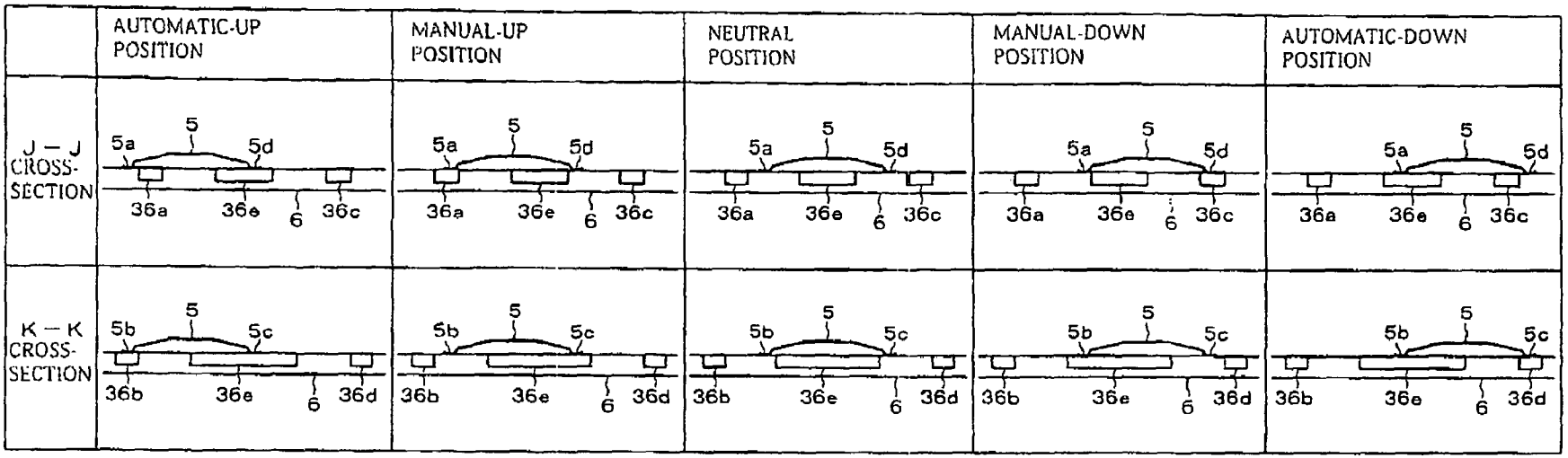
FIG. 13 is a diagram showing the contact states of the movable contacts and the fixed contacts according to another embodiment.

FIG. 13 is a diagram showing the contact states of the movable contacts 5*a* to 5*d* and the fixed contacts 36*a* to 36*e* in a tabular form. In FIG. 13, the upper stage shows the J-J cross-section traversing the movable contacts 5*a*, 5*d* and the fixed contacts 36*a*, 36*c*, 36*e*, and the lower stage shows the K-K cross-section traversing the movable contacts 5*b*, 5*c* and the fixed contacts 36*b*, 36*d*, 36*e*. When the knob 2 is located at the neutral position N, as indicated on the third column from the left side of FIG. 13, the movable piece 5 is located at the center of the earth fixed contact 36*e*, all the movable contacts 5*a* to 5*d* and the fixed contacts 36*a* to 36*e* are separated from one another, and the fixed contacts 36*a* to 36*e* are kept under the non-conduction state. When the knob 2 is rotated till the manual-up position MU, as indicated on the second column from the left side of FIG. 13, the movable piece 5 moves in parallel to the left, the movable contact 5*c* comes into contact with the earth fixed contact 36*e*, the movable contact 5*a* comes into contact with the manual-up fixed contact 36*a*, and the fixed contacts 36*a*, 36*e* are conducted to each other. When the knob 2 is rotated till the automatic-up position AU, as indicated on the first column from the left side of FIG. 13, the movable piece 5 moves in parallel to the left, the movable contact 5*a* is separated from the manual-up fixed contact 36*a*, the movable contact 5*b* comes into contact with the automatic-up fixed point 36*b*, the movable contacts 5*c*, 5*d* come into contact with the fixed contact 36*e*, and the fixed contacts 36*b* and 36*e* are conducted to each other. When the knob 2 is rotated till the manual-down position MD, as indicated on the second column from the right side of FIG. 13, the movable piece 5 moves in parallel to the right, the movable contact 5*d* comes into contact with the manual-down fixed contact 36*c*, the movable contact 5*b* comes into contact with the earth fixed contact 36*e*, and the fixed contacts 36*c*, 36*e* are conducted to each other. When the knob 2 is rotated till the automatic-down position AD, as indicated on the first column from the right side of FIG. 13, the movable piece further moves in parallel to the right, the movable contact 5*d* is separated from the manual-down fixed contact 36*c*, the movable contact 5*c* comes into contact with the automatic-down fixed contact 36*d*, the movable contacts 5*a*, 5*b* come into contact with the earth fixed contact 36*e*, and the fixed contacts 36*d*, 36*e* are conducted to each other.

In the above construction, even when the other fixed contacts 6*a* to 6*d*, 16*a* to 16*d*, 26*a* to 26*d*, 36*a* to 36*d* are not provided so as to be far away from the right and left sides of the earth fixed contacts 6*e*, 16*e*, 26*e*, 36*e*, the insulating interval between the manual-up/down fixed contact 6*a*, 6*c*, 16*a*, 16*c*, 26*a*, 26*c*, 36*a*, 36*c* and the earth fixed contact 6*c*, 16*e*, 26*e*, 36*e* can be increased. Therefore, it is possible to prevent detraction of the insulation of the insulator between the earth fixed contact 6*e*, 16*e*, 26*e*, 36*e* and the manual-up/down fixed contact 6*a*, 6*c*, 16*a*, 16*c*, 26*a*, 26*c*, 36*a*, 36*c* due to the adhesion of powder having electrical conductivity to the surface of the insulator between earth fixed contact 6*e*, 16*e*, 26*e*, 36*e* and the manual-up/down fixed contact 6*a*, 6*c*, 16*a*, 16*c*, 26*a*, 26*c*, 36*a*, 36*c*, the electrical powder being generated due to wearing of the contacts 6*a*, 6*c*, 6*e*, 16*a*, 16*c*, 16*e*, 26*a*, 26*c*, 26*e*, 36*a*, 36*c*, 36*e*, 5*a* to 5*d* by arc discharge occurring when the earth fixed contact 6*e*, 16*e*, 26*e*, 36*e* and the manual-up/down fixed contact 6*a*, 6*c*, 16*a*, 16*c*, 26*a*, 26*c*, 36*a*, 36*c* are opened/closed (that is, the movable contacts 5*a* to 5*d* separate/approach from/to the fixed contacts 6*a*, 6*c*, 6*e*, 16*a*, 16*c*, 16*e*, 26*a*, 26*c*, 26*e*, 36*a*, 36*c*, 36*e*). Furthermore, there can be also prevented the detraction of the insulation due to the adhesion of foreign matters having electrical conductivity to the surface of the insulator between the earth fixed contact 6*e*, 16*e*, 26*e*, 36*e* and the manual-up/down fixed contact 6*a*, 6*c*, 16*a*, 16*c*, 26*a*, 26*c*, 36*a*, 36*c*. Still furthermore, high precision is not required for the design, manufacturing and assembling works the movable contacts 5*a* to 5*d*, the fixed contacts 6*a* to 6*e*, 16*e* to 16*e*, 26*a* to 26*e*, 36*a* to 36*e* and for the respective parts such as the movable piece 5, the board 6, etc., and the works concerned can be easily performed. Still furthermore, the occupational area of the fixed contacts 6*a* to 6*e*, 16*a* to 16*e*, 26*a* to 26*e*, 36*a* to 36*e* on the board 6 can be suppressed from being increased, and the power window switch 1 can be miniaturized.

As shown in FIG. 6 and FIG. 7 or FIG. 8 and FIG. 9, the manual-up/down fixed contacts 6*a*, 6*c*, 16*a*, 16*c* and each insulator between the earth fixed contact 6*e*, 16*e* and the manual-up/down fixed contact 6*a*, 6*c*, 16*a*, 16*c* are arranged obliquely to the sliding direction of the movable contacts 5*a* to 5*d*, and thus the interval concerned can be increased. Therefore, even when electrically conductive or electrically non-conductive foreign matters adhere to the surface of the insulator between the earth fixed contact 6*e*, 16*e* and the manual-up/down fixed contact 6*a*, 6*c*, 16*a*, 16*c*, the foreign matters concerned can be prevented from being moved from the surface of one insulator to the surface of the other surface in connection with the sliding movement of the movable contacts 5*a* to 5*d*. The insulation between the earth fixed contact 6*e*, 16*e* and the manual-up/down fixed contact 6*a*, 6*c*, 16*a*, 16*c* and the contact reliability between the fixed contact 6*a*, 6*c*, 6*e*, 16*a*, 16*c*, 16*e* and each of the movable contact 5*a* to 5*d* can be prevented from being detracted.

According to the construction as shown in FIGS. 6 and 7 or FIGS. 10 and 11, there can be provided five switchable electrical connection states of a state that all the movable contacts 5*a* to 5*d* are separated from the fixed contacts 6*a* to 6*e*, 26*a* to 26*e* by the linear reciprocating motion of the movable piece 5 and thus the contacts 6*a* to 6*e*, 26*a* to 26*e* are not conducted to one another, a state that the movable contact 5*a* and 5*d* or 5*c* come into contact with the manual-up fixed contact 6*a*, 26*a* and the earth fixed contact 6*e*, 26*e* and thus the contacts 6*a*, 6*e*, 26*a*, 26*e* are conducted to one another, a state that the movable contacts 5*a* to 5*d* come into contact with the manual-up fixed contact 6*a*, 26*a*, the automatic-up fixed contact 6*b*, 26*b* and the earth fixed contact 6*e*, 26*e*, and thus the contacts 6*a*, 6*b*, 6*e*, 26*a*, 26*b*, 26*e* are conducted to one another, a state that the movable contacts 5*c* or 5*d* and 5*b* come into contact with the manual-down fixed contact 6*c*, 26*c* and the earth fixed contact 6*e*, 26*e*, and thus the contacts 6*c*, 6*e*, 26*c*, 26*e* are conducted to each other, and a state that the movable contacts 5*a* to 5*d* come into contact with the manual-down fixed contact 6*c*, 26*c*, the automatic-down fixed contact 6*d*, 26*d* and the earth fixed contact 6*e*, 26*e* and thus the contacts 6*c*, 6*d*, 6*e*, 26*c*, 26*d*, 26*e* are conducted to one another.

Furthermore, according to the construction as shown in FIGS. 8 and 9 or FIGS. 12 and 13, there can be provided five switchable electrical connection states of a state that all the movable contacts 5*a* to 5*d* are separated from the fixed contacts 16*a* to 16*e*, 36*a* to 36*e* by the linear reciprocating motion of the movable piece 5 and thus the contacts 16*a* to 16*e*, 36*a* to 36*e* are not conducted to one another, a state that the movable contacts 5*a* and 5*d* or 5*c* come into contact with the manual-up fixed contact 16*a*, 36*a* and the earth fixed contact 16*e*, 36*e* and thus the contacts 16*a*, 16*e*, 36*a*, 36*e* are conducted to one another, a state that the movable contacts 5*b* to 5*d* come into contact with the automatic-up fixed contact 16*b*, 36*b* and the earth fixed contact 16*e*, 36*e* and thus the contacts 16*b*, 16*e*, 36*b*, 36*e* are conducted to each other, a state that the movable contacts 5*c* or 5*d* and 5*b* come into contact with the manual-down fixed contact 16*c*, 36*c* and the earth fixed contact 16*e*, 36*e* and thus the contacts 16*c*, 16*e*, 36*c*, 36*e* are conducted to each other, and a state that the movable contacts 5*a* and 5*b* or 5*d* come into contact with the earth fixed contact 16*e*, 36*e* and the automatic-down fixed contact 16*d*, 36*d* and thus the contacts 16*d*, 16*e*, 36*d*, 36*e* are conducted to each other.

The present invention may adopt various modifications other than the above-described embodiments. For example, in the above-described embodiments, the movable piece 5 and the movable contacts 5*a* to 5*d* are provided at the upper side of the board 6 (at the knob 2 side) and the fixed contacts 6*a* to 6*e*, 16*a* to 16*e*, 26*a* to 26*e*, 36*a* to 36*e* are provided on the upper surface of the board 6. However, the movable piece and the movable contacts may be provided below the board (at the opposite side to the knob) and the fixed contacts may be provided to the lower surface of the board. In this case, the slider for holding the movable piece is provided at the lower side, and the operator for transferring the manipulating force with which the movable piece is made to linearly reciprocate is made to penetrate through the board.

Furthermore, in the above-described embodiments, the present invention is applied to the power window switch 1. However, the present invention is not limited to the above embodiments, and it can be generally applied to a tumbler switch, a slide switch, etc. for making an operation target do some action.

What is claimed is:

1. A switch comprising:

a fixed contact provided to a board, and a movable contact slidable on the fixed contact provided to a movable piece reciprocable in the right and left direction, wherein the fixed contact comprises a first fixed contact provided at center thereof, second and third fixed contacts provided to one of the right and left sides of the first fixed contact, and fourth and fifth fixed contacts provided to other side, the second and fifth fixed contacts are aligned with one another in a sliding direction of the movable contact, the third and fourth fixed contacts are aligned with one another in a sliding direction of the movable contact, wherein, in the sliding direction, distance between the second fixed contact and the first fixed contact is set to be shorter than distance between the third fixed contact and the first fixed contact, wherein, in the sliding direction, distance between the fourth fixed contact and the first fixed contact is set to be shorter than distance between the fifth fixed contact and the first fixed contact, the first fixed contact is configured such that a side portion thereof near to the second and fourth fixed contacts is concaved with respect to a side portion thereof near to the third and fifth fixed contacts, wherein when the movable contact slides in one of the right and left direction from an initial state in which the movable contact contacts none of the first, second, and third fixed contacts to a final state in which the movable contact contacts all of the first, second, and third fixed contacts, the movable contact moves through a transitional state in which the movable contact only contacts the first fixed contact but neither the second nor third fixed contact, and wherein when the movable contact slides in the other of the right and left direction from an initial state in which the movable contact contacts none of the first, fourth, and fifth fixed contacts to another final state in which the movable contact contacts all of the first, fourth, and fifth fixed contacts, the movable contact moves through another transitional state in which the movable contact only contacts the first fixed contact but neither the fourth nor fifth fixed contact.

2. The switch according to claim 1, wherein the second and fifth fixed contacts are aligned in the sliding direction of the movable contact so as to sandwich the first fixed contact therebetween, and the third and fourth fixed contacts are aligned in the sliding direction of the movable contact so as to sandwich the first fixed contact therebetween.

3. The switch according to claim 2, wherein the second and third fixed contacts are provided so as to come into contact with the second fixed contact when the movable point comes into contact with the third fixed contact, and the fourth and fifth fixed contacts are provided such that the movable contact comes into contact with the fourth fixed contact when the movable contact comes into contact with the fifth fixed contact.

4. The switch according to claim 3, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

5. The switch according to claim 2, wherein the second and third fixed contacts are provided such that the movable contact is in non-contact with the second fixed contact when the movable point comes into the third fixed contact, and the fourth and fifth fixed contacts are provided such that the movable contact is in non-contact with the fourth fixed contact when the movable point comes into contact with the fifth fixed contact.

6. The switch according to claim 5, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

7. The switch according to claim 2, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

8. The switch according to claim 1, wherein the second and third fixed contacts are provided such that the movable contact comes into contact with the second fixed contact when the movable point comes into contact with the third fixed contact, and the fourth and fifth fixed contacts are provided so as to come into contact with the fourth fixed contact when the movable contact comes into contact with the fifth fixed contact.

9. The switch according to claim 8, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

10. The switch according to claim 1, wherein the second and third fixed contacts are provided such that the movable contact is in non-contact with the second fixed contact when the movable point comes into the third fixed contact, and the fourth and fifth fixed contacts are provided such that the movable contact is in non-contact with the fourth fixed contact when the movable point comes into contact with the fifth fixed contact.

11. The switch according to claim 10, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

12. The switch according to claim 1, wherein the switch comprises a power window switch for operating a power window mounted in a vehicle, the first fixed contact comprises a grounded fixed contact for earth, the second fixed contact comprises a manual-up fixed contact for manually moving the power window upwardly, the third fixed contact comprises an automatic-up fixed contact for automatically moving the power window upwardly, the fourth fixed contact comprises a manual-up fixed contact for manually moving the power window downwardly, and the fifth fixed contact comprises an automatic-down fixed contact for automatically moving the power window downwardly.

* * * * *